United States Patent [19]

Merkel

[11] Patent Number: 4,613,059

[45] Date of Patent: Sep. 23, 1986

[54] PRESSURE PULSE MASKING CIRCUIT FOR A PRESSURE MONITOR IN A DISPENSING SYSTEM

[75] Inventor: Stephen L. Merkel, Bay Village, Ohio

[73] Assignee: Nordson Corporation, Amherst, Ohio

[21] Appl. No.: 734,122

[22] Filed: May 15, 1985

[51] Int. Cl.[4] ..... B67D 5/08; B67D 5/14

[52] U.S. Cl. ..... 222/52; 222/55; 307/308; 307/491; 73/753

[58] Field of Search ..... 222/52, 55, 61, 63, 222/504; 307/308, 491, 494, 530, 542; 73/753

[56] References Cited

U.S. PATENT DOCUMENTS

| | | | |
|---|---|---|---|
| 3,252,441 | 5/1966 | Hargreaves | 222/52 X |
| 3,585,510 | 6/1971 | O'Malley | 307/494 X |
| 3,663,887 | 5/1972 | Dix | 307/530 |
| 3,817,106 | 6/1974 | Hobel | 73/753 |
| 3,842,291 | 10/1974 | Maringer | 307/542 X |
| 4,112,317 | 9/1978 | Everswick | 307/308 |
| 4,144,986 | 3/1979 | Smith et al. | 222/52 |
| 4,218,662 | 8/1980 | Schröder | 307/542 |
| 4,430,886 | 2/1984 | Rood . | |
| 4,445,093 | 4/1984 | Kohler | 307/308 X |
| 4,453,652 | 6/1984 | Merkel et al. | 222/504 |
| 4,470,017 | 9/1984 | Eder | 307/542 X |
| 4,545,504 | 10/1985 | Fabel et al. | 222/63 X |

*Primary Examiner*—Joseph J. Rolla
*Assistant Examiner*—P. McCoy Smith
*Attorney, Agent, or Firm*—Wood, Herron & Evans

[57] ABSTRACT

A pressure monitoring system monitors the pressure of hot melt adhesive in a dispenser in an adhesive dispensing system. The dispenser includes a valve and the dispensing system further includes a controller for opening and closing the valve for dispensing pressurized hot melt adhesive from the dispenser. The pressure monitoring system includes a sensor circuit which develops an electrical pressure signal reflective of the pressure of adhesive in the dispenser and a pressure monitor circuit which monitors the electrical pressure signal when the dispenser valve is open. A pulse masking circuit is interposed between the pressure sensor circuit and the pressure monitor circuit to modify the signal produced by the pressure sensor circuit to mask out a transient leading edge, reduced pressure pulse appearing in the electrical pressure signal each time the valve is opened. In this way, the signal received by the pressure monitor circuit is free of such reduced pressure pulses, so that the pressure monitor circuit can properly monitor the actual fluid pressure at the dispenser when the valve is open.

3 Claims, 8 Drawing Figures

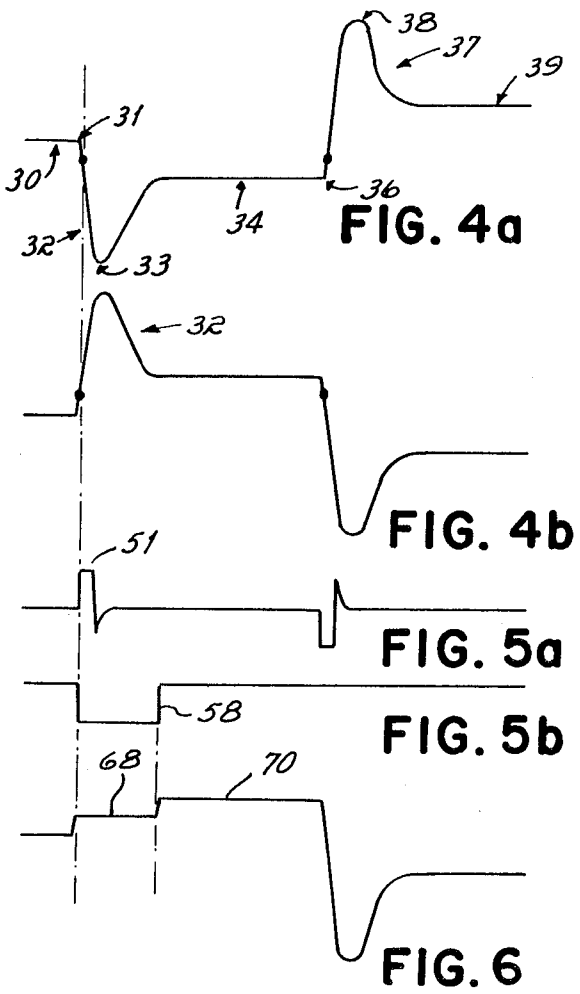
FIG. 4a
FIG. 4b
FIG. 5a
FIG. 5b
FIG. 6
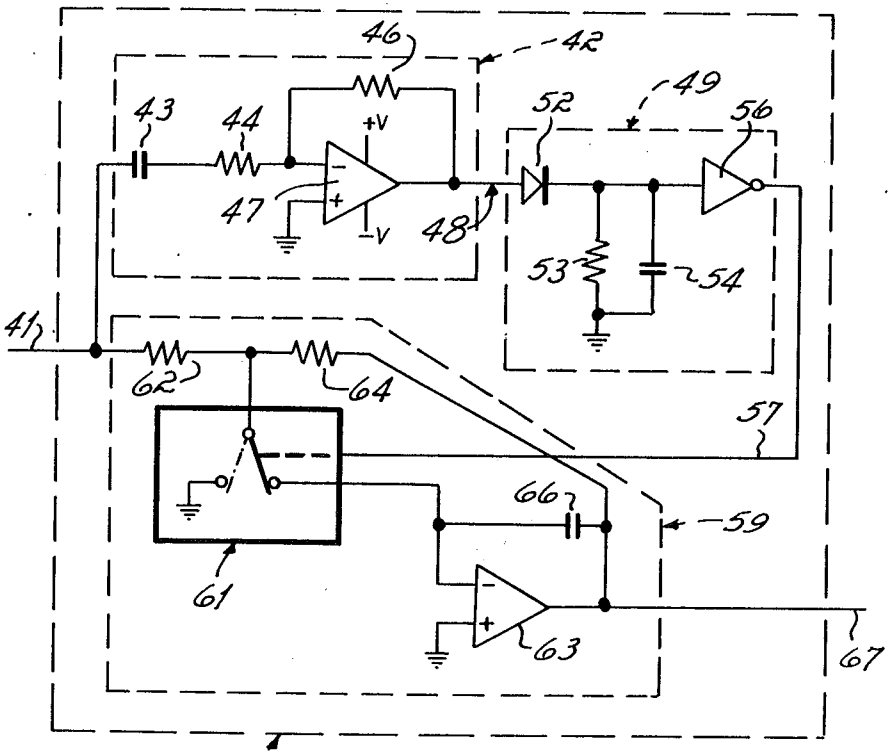
FIG. 3

PRESSURE PULSE MASKING CIRCUIT FOR A PRESSURE MONITOR IN A DISPENSING SYSTEM

DESCRIPTION OF THE INVENTION

This invention relates generally to fluid dispensing systems and more particularly concerns such a system including a pressure monitor for fluid in a dispenser.

In fluid systems having a fluid dispenser, it is often advantageous to monitor the flow conditions at the fluid dispenser as an indication of proper flow. In pressurized fluid dispensing systems, wherein pressurized fluid is supplied to a dispenser which is opened and closed to permit and prevent dispensing of the fluid, and particularly in pressurized liquid dispensing systems, the pressure of the dispensed material can be monitored as an indication of flow rate.

Among the "liquids" dispensed by such systems are liquids carrying particulate solids, molten solids, and other relatively non-compressible flowable materials. Such liquid-dispensing systems find a wide application in industry, including spray painting installations and the dispensing of adhesives onto substrates.

In one illustrative application, to be described more particularly hereinafter, a hot melt adhesive is intermittently supplied from a pressurized hot melt adhesive dispenser by opening and closing a valve in the dispenser. In such a system, one parameter of interest is the pressure at the dispenser when the valve is opened, since such pressure, under normal operating conditions, is reflective of the flow rate of the adhesive from the dispenser. If this pressure increases, it is usually indicative of a clogged dispenser nozzle, and if this pressure becomes too low, it may be reflective of a worn nozzle opening, permitting too great a flow of adhesive.

A Dispenser Malfunction Detector (for fluid dispensers) is described in my patent application Ser. No. 474,201, filed Mar. 10, 1983, now abandoned which discloses a system for monitoring dispenser pressure when a dispenser valve is open to detect flow abnormalities. The malfunction detector includes pressure monitoring circuitry substantially functioning as a peak detector for monitoring each (negative-going) pressure peak, which occurs each time the dispenser valve is opened.

In hot melt adhesive dispensing systems, and other liquid dispensing systems, the opening of the dispenser valve often creates an initial (negative-going) pressure pulse before the pressure in the dispenser settles to a steady state value during the time that the dispenser valve is open. Such a pressure pulse may be produced, for example, by the retraction of a portion of a valve armature from the dispenser cavity, creating a momentary partial vacuum in the dispenser.

It has been found that employing the above-mentioned Dispenser Malfunction Detector in such a liquid dispensing system results in erroneous pressure indications since the detector is influenced by the transient (negative-going) pressure pulses which occur when the dispenser valve is opened. Such erroneous pressure indications then result in erroneous flow rate indications.

It would be advantageous to utilize a malfunction detector, such as the above-mentioned Dispenser Malfunction Detector, in a fluid dispensing arrangement such as in a system for the dispensing of hot melt adhesive as earlier described. However, the creation of transient pressure pulses each time the dispenser valve is opened has in many cases rendered this impossible.

It has been found that if the dispenser pressure signal supplied to a pressure monitoring system, such as the Dispenser Malfunction Detector, is subjected to sufficient low pass filtering, much of each objectionable pressure pulse can be eliminated. However, in many hot melt adhesive dispensing systems, the speed of operation of the dispenser valve is such that the required filtering also masks the pressure peaks which are to be monitored. Therefore, in many such liquid dispensing applications, filtering the pulse-containing pressure signal is not practical.

It has been an objective of the present invention, therefore, to provide a means for utilizing a dispenser pressure monitoring system, such as the above-mentioned Dispenser Malfunction Detector, in dispensing systems wherein the opening of the dispenser valve is accompanied by the production of a transient pressure pulse.

In accomplishing this objective, an electrical pressure sensor signal, reflective of pressure variations at a fluid dispenser, is modified by a pulse masking circuit to produce an electrical output signal in which transient pressure pulses occurring when the dispenser is opened are masked. As shall be described hereinafter with regard to a particular embodiment of the invention, one form of the pulse masking circuit includes circuitry for sensing the occurrence of a negative-going transient pressure pulse in a pressure sensor signal when a hot melt adhesive dispenser valve is opened. The pulse masking circuit further includes circuitry for producing an output signal, which tracks the pressure sensor signal, with the exception that each transient pressure pulse is masked therefrom.

In the particular circuitry employed in the illustrated embodiment of the invention, the masking circuit includes an amplifier which, in the absence of a transient pressure pulse, amplifies the electrical pressure sensor signal to produce the output signal. When a transient pressure pulse is sensed, the amplifier is switched to a "hold" condition in which the amplifier output is held substantially at the same level (as that which existed when the pulse was first sensed), for a selected interval (selected to be at least as long as the greatest expected transient pulse duration), and then returned to the amplifier mode.

The operation of the disclosed pulse masking circuit will become apparent upon reading the following detailed description and upon reference to the drawings, in which:

FIG. 3 is a circuit diagram of the pulse masking circuit of FIG. 1;

Figure 1:
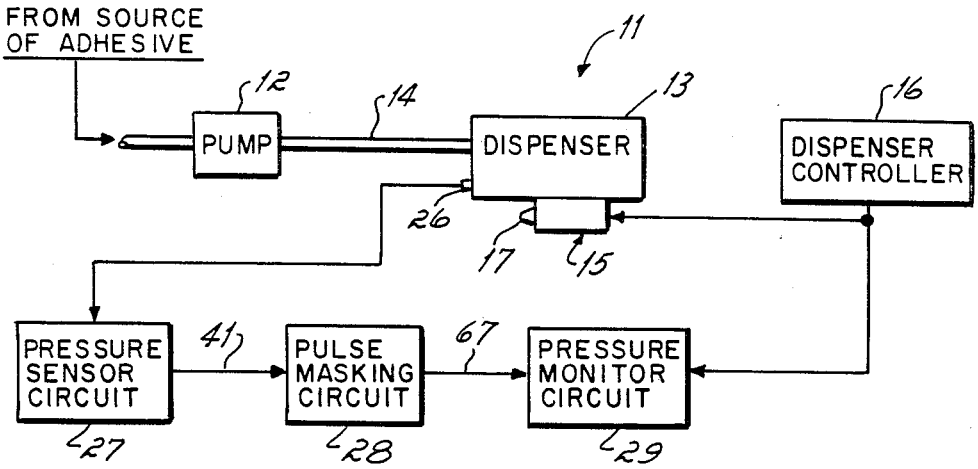
FIG. 1 is a diagrammatic illustration of a hot melt adhesive dispensing system and pressure monitoring system having a pulse masking circuit.

FIG. 4*a* is a diagrammatic illustration of a pressure sensor signal produced in the pressure monitoring system of FIG. 1;

FIG. 4*b* is an illustration of the pressure sensor signal of FIG. 4*a* in which the signal is inverted;

FIGS. 5*a* and 5*b* are diagrammatic illustrations of waveforms produced in the pulse masking circuit of FIG. 3; and FIG. 6 is a diagrammatic illustration of an electrical output signal produced by the pulse masking circuit of FIG. 3.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

Figure 2:
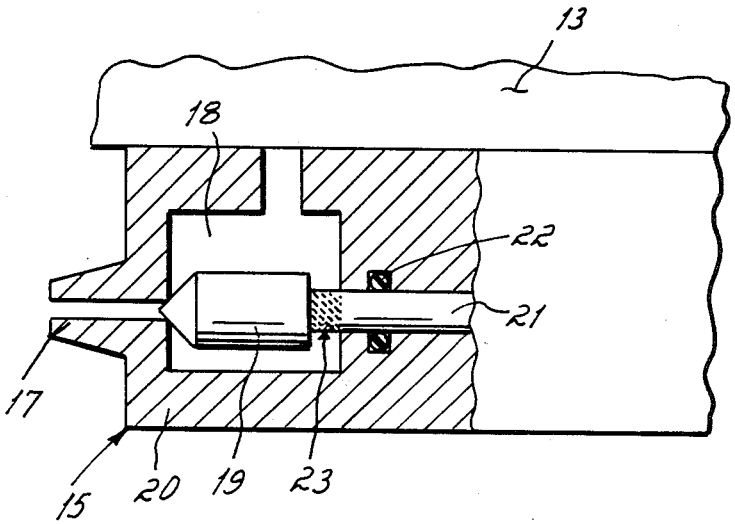
FIG. 2 is a diagrammatic illustration of the dispensing valve of the dispensing system of FIG. 1.

With initial reference to FIG. 1, an exemplary hot melt adhesive dispensing system 11 includes a pump 12 for supplying suitably molten hot melt adhesive from an adhesive source to a dispenser 13 via a conduit such as a hose 14. The adhesive is supplied in a molten condition to the pump 12 and suitable heaters (not shown) are employed in conjunction with the hose 14 and the dispenser 13 to maintain the adhesive in a dispensable molten condition. A dispenser controller 16 supplies electrical pulse control signals to an electrically controlled valve 15. The valve 15 is opened and closed to permit and prevent, respectively, the dispensing of adhesive from the dispenser 13 through a nozzle 17. As best seen in FIG. 2, the dispenser valve 15 in the illustrated hot melt adhesive dispensing system 11 includes an adhesive cavity 18 and a valve element 19 in a valve body 20. The element 19 is carried by a reciprocating rod 21 extending through a wall of the valve body 20 surrounded by suitable seals 22. When the valve element 19 is moved to a valve-open position, to permit the flow of pressurized adhesive through the mozzle 17, the portion 23 of the rod 21 initially in the adhesive cavity 18 is retracted from the adhesive cavity, creating a partial vacuum. This partial vacuum gives rise to a large negative-going transient pressure pulse within the valve body 20 and the dispenser 13. When the valve element 19 is returned to the closed position illustrated in FIG. 2, the rod portion 23 enters the cavity 18, creating a large positive-going transient pressure pulse. The rod 21 of the valve 15 is reciprocated by suitable means (not shown), such as a solenoid, under the influence of the control pulses from the dispenser controller 16.

The pressure of the adhesive in the dispenser 13 is monitored by a pressure sensor 26, which cooperates with a pressure sensor circuit 27 to produce an output electrical pressure sensor signal. A portion of that signal, over an interval of time within which the valve 15 is opened and closed, is shown in FIG. 4*a*. The output of the pressure sensor circuit 27 is coupled to a pulse masking circuit 28, which modifies the electrical pressure sensor signal to produce a modified electrical output signal, as shown in FIG. 6. This output signal is coupled to a pressure monitor circuit 29 which includes circuitry for monitoring the "steady state" pressure value of the output signal when the valve 17 is opened. In order to permit the pressure monitor circuit 29 to recognize when the valve 15 is opened, the valve control signal from the dispenser controller 16 is coupled to the pressure monitor circuit.

If the output of the pressure sensor circuit 27 were coupled directly to the pressure monitor circuit 29, the two circuits 27 and 29 together would comprise a dispenser malfunction detector of the form disclosed in my above-mentioned patent application, entitled "Dispenser Malfuntion Detector", which is incorporated herein by reference. As disclosed therein, the pressure sensor circuit 27 includes a preamplifier having an input which is coupled to a dispenser pressure sensor and having an output which is ac coupled to the input of an operational amplifier. The output of the operational amplifier in that system is equivalent to the output signal of the pressure sensor circuit 27. The pressure monitor circuit 29, as embodied in the above-mentioned Dispenser Malfunction Detector, serves to monitor the peak values of pressure occurring when the valve 15 is open, under the control of the the dispenser controller 16.

With further reference now to FIGS. 4*a* and 4*b*, FIG. 4*a* illustrates the electrical pressure sensor signal output of the pressure sensor circuit 27. As shown, for one interval during which the valve 15 is opened and closed, the pressure sensor signal begins at a "steady state" level 30 for the valve-closed condition. At the point 31, the valve is opened and the pressure drops as reflected by a "leading edge", negative-going, pressure pulse 32. After the pressure reaches a lowest value, as indicated at point 33, the pressure rises to assume a steady state valve-open level 34. The pressure remains at this level 34 until the valve is closed, which occurs at the point 36. Closing the valve results in a positive-going, "trailing edge", pressure pulse 37, which reaches a peak value 38 and then returns to the steady state valve-closed level 39. The level 39 corresponds to the level 30 if the pressure under which the adhesive is supplied to the dispenser remains the same.

Considering the pulse masking circuit 28, which receives the electrical pressure sensor signal from the pressure sensor circuit 27, in more detail, and with reference now to FIG. 3, the pulse masking circuit receives the output signal from the pressure sensor circuit 27, as reflected by the waveform of FIG. 4*a*, at an input 41. The electrical pressure sensor signal received at the input 41 is coupled to a differentiator and limiter circuit 42, which includes a capacitor 43 and a resistor 44 connected in series between the input 41 and the inverting input of an operational amplifier 47. The non-inverting input of the operational amplifier 47 is grounded, and a feedback resistor 46 is connected between the output of the operational amplifier and its inverting input. The differentiator and limiter 42 generates a relatively large amplitude, short duration, inverted pulse in response to a steep waveform in the electrical pressure sensor signal. As shown in FIG. 5*a*, the pulses produced at the output 48 of the amplifier 47 occur at the beginning of each leading edge pressure pulse and at the beginning of each trailing edge pressure pulse.

The positive pulses, such as the pulse 51, at the output 48 are coupled through a diode 52 in a pulse stretching circuit 49. The pulse stretching circuit 49 also includes a resistor 53, a capacitor 54, and an inverter 56. The resistor 53, the capacitor 54, and the inverter 56 form a Schmitt inverter, producing at its outpout 57 a stretched, inverted pulse 58, as shown in FIG. 5*b*.

The electrical pressure sensor signal at the input 41 is also coupled to an inverting amplifier circuit 59. The amplifier circuit 59 also serves as a "hold" circuit, as shall be described.

The pulse signal on the line 57 which is produced by the pulse stretching circuit 49 is coupled to an analog switch 61, shown diagrammatically in FIG. 3. A suitable analog switch 61 is a CMOS 4053 integrted circuit. With the switch 61 in the position illustrated in FIG. 3, the circuit 59 is connected in an amplifier mode.

With the circuit 59 in this amplifier mode, the electrical pressure sensor signal at the input 41 is coupled through a resistor 62 and the switch 61 to the inverting input of an operational amplifier 63. The non-inverting input of the amplifier 63 is connected to ground, and a feedback resistor 64 is coupled from the output of the amplifier 63, via the switch 61, to the inverting input of the amplifier. A feedback capacitor 66 is also connected between the output and the inverting input of the amplifier 63.

In the configuration of the circuit 59 illustrted in FIG. 3, the circuit serves as an inverting amplifier and substantially produces an output 67 which is an inverted form of the signal of FIG. 4*a*. For purposes of illustration, an inverted representation of the electrical pressure sensor signal is shown in FIG. 4*b*.

In order to produce an output signal at the output 67 from which the leading edge pulse 32 (FIGS. 4*a* and 4*b*) is masked, the pulse signal on the line 57 controls the analog switch 61 to remove the electrical pressure sensor signal from the inverting input of the amplifier 63 during the occurrence of the transient leading edge pulse 32. In order to do this, when the signal on the line 57 pulses low, the switch 61 assumes the dotted line position shown in FIG. 3, in which the junction between the resistors 62 and 64 is coupled to ground rather than to the inverting input of the amplifier 63. In this configuration, the circuit 59 no longer amplifies, but instead holds its output voltage, on the line 67, at the last voltage value occurring before the switch 61 changed conditions. This voltage is stored on the capacitor 66.

Therefore, when a leading edge pulse appears at the input 41, the circuit 59 quickly switches from an "amplify" mode to a "hold" mode for a predetermined length of time, replacing the transient pulse with a voltage value close to the value that existed before the pulse began. This "hold", or masking, portion of the output signal 67 is indicated as 68 in the output waveform of FIG. 6. As can be seen in the waveform of FIG. 6, the transient leading edge pulse has been eliminated. In its place is the masking voltage 68, which is of less amplitude than the "steady state," valve open, voltage 70. Therefore, the waveform of FIG. 6 can be evaluated by the pressure monitor circuit 29 without a leading edge pulse disturbing the function of the monitor circuit.

As shown in the waveforms of FIGS. 5*b* and 6, when the Schmitt inverter pulse ends, the circuit 59 resumes functioning as an amplifier, tracking the inverted transducer output. Depending upon the slope of the typical transient leading edge pulse to be encountered by the pulse masking circuit 28, the resistors 44 and 46 in the differentiator circuit 42 are adjusted to obtain the desired sensitivity. The resistor 53 in the Schmitt inverter circuit 49 is adjusted to obtain the desired length of masking pulse at the output 57, and the gain of the amplifier circuit 59 is adjusted by varying the value of the resistor 62. The length of the masking pulse at the output 57 is selected to be at least as great as the duration of the longest expected leading edge transient pressure pulse.

What is claimed is:

1. In a hot melt adhesive dispensing system including (a) a dispenser for pressurized hot melt adhesive, (b) means for opening and closing an adhesive outlet of the dispenser to permit and prevent the dispensing of adhesive and resulting in variations in pressure of adhesive in the dispenser, including reduced pressure pulses occurring at times when the adhesive outlet is opened, (c) means for producing an electrical pressure sensor signal reflective of pressure variations in adhesive in the dispenser including pulse signals reflective of said reduced pressure pulses, and (d) means for monitoring an output electrical signal substantially during times that the adhesive outlet is open; a pulse masking circuit comprising:

pulse sensing means, coupled to said electrical pressure sensor signal, for sensing the occurrence of pulse signals reflective of reduced pressure pulses; and means, coupled to the pulse sensing means and receiving said electrical pressure sensor signal, for modifying the electrical pressure sensor signal upon the sensing of the occurrence of one of said pulse signals by the pulse sensing means to produce the output electrical signal reflective of pressure variations in adhesive in the dispenser in which said pulse signals are replaced by masking signals, the output electrical signal being coupled to the monitoring means.

2. The system of claim 1 in which the pulse sensing means includes means for producing a control signal of selected duration commencing when the pulse sensing means senses the occurrence of a pulse signal reflective of a reduced pressure pulse, and in which the means for modifying the electrical pressure sensor signal includes an amplifier circuit having an input coupled to the electrical pressure sensor signal and producing, at an output, said output electrical signal, the amplifier circuit having a first state in which the signal at its output substantially reflects the signal at its input, the amplifier circuit being responsive to said control signal to assume a second state for the duration of the control signal in which the amplifier circuit output is held at a substantially constant level.

3. A pressure monitoring system, for a fluid dispensing arrangement having a dispenser for pressurized fluid and means for opening and closing a fluid outlet of the dispenser to permit and prevent the dispensing of fluid resulting in variations in the pressure of fluid in the dispenser including reduced pressure pulses occurring at times that the fluid outlet is opened, comprising:

means for producing an electrical pressure sensor signal, reflective of pressure variations in fluid in a dispenser, including transient pulse signals reflective of reduced pressure pulses produced when a dispenser fluid outlet is opened;

means for monitoring an output electrical signal substantially during times that a fluid dispenser outlet is open;

pulse sensing means, coupled to said electrical pressure sensor signal, for sensing the occurrence of transient pulse signals reflective of reduced pressure pulses; and means, coupled to the pulse sensing means and receiving said electrical pressure sensor signal, for modifying the electrical pressure sensor signal upon the sensing of the occurrence of one of said pulse signals by the pulse sensing means to produce the output electrical signal reflective of pressure variations in fluid in a dispenser in which said transient pulse signals are replaced by masking signals, the output electrical signal being coupled to the monitoring means.

* * * * *